US006431548B1

(12) United States Patent
Voigt, IV et al.

(10) Patent No.: US 6,431,548 B1
(45) Date of Patent: Aug. 13, 2002

(54) GAME PLAYING APPARATUS

(75) Inventors: Carl E. Voigt, IV, Indianapolis, IN (US); Cheung King Chow, New Territories (HK)

(73) Assignee: Fundex Games, Ltd., Indianapolis, IN (US)

( * ) Notice: Subject to any disclaimer, the term of this patent is extended or adjusted under 35 U.S.C. 154(b) by 0 days.

(21) Appl. No.: 09/346,037

(22) Filed: Jul. 6, 1999

Related U.S. Application Data

(62) Division of application No. 08/716,050, filed on Sep. 19, 1996, now Pat. No. 5,918,880, which is a division of application No. 08/386,291, filed on Feb. 9, 1995, now Pat. No. 5,588,654.

(51) Int. Cl.[7] ..... A63F 3/00

(52) U.S. Cl. ..... 273/284; 273/239; 273/287; 273/138.1; 273/143 A

(58) Field of Search ..... 273/143, 284, 273/239, 287, 142 R, 143 A, 142 J, 138.1, 145 C, 145 R, 145 CA, 249

(56) References Cited

U.S. PATENT DOCUMENTS

| | | | | |
|---|---|---|---|---|
| 518,316 | A | | 4/1894 | Grove |
| 646,549 | A | * | 4/1900 | Aberli |
| 2,099,173 | A | | 11/1937 | Norris |
| 2,548,837 | A | | 4/1951 | Wright |
| 2,731,267 | A | | 1/1956 | Brenner |
| 2,800,330 | A | * | 7/1957 | Pickard |
| 2,842,368 | A | | 7/1958 | Williams |
| 3,087,258 | A | | 4/1963 | Anderson |
| 3,111,321 | A | * | 11/1963 | Hormann |
| 3,164,918 | A | | 1/1965 | Brown |
| 3,356,369 | A | * | 12/1967 | Stubbmann |
| 3,481,605 | A | * | 12/1969 | Giraurd |
| 3,655,199 | A | | 4/1972 | Ohki |
| 3,733,076 | A | | 5/1973 | Ohki |
| 3,735,987 | A | | 5/1973 | Ohki |
| 3,762,715 | A | | 10/1973 | Howard |
| 3,831,947 | A | | 8/1974 | Bittner |
| 3,926,439 | A | * | 12/1975 | Chao |
| 4,114,290 | A | * | 9/1978 | Cooper |
| 4,134,592 | A | | 1/1979 | Pullman |
| 4,961,581 | A | * | 10/1990 | Barnes |
| 4,981,300 | A | * | 1/1991 | Winkler |
| 5,370,397 | A | * | 12/1994 | Miller |
| 5,413,352 | A | * | 5/1995 | Persidsky |
| 5,711,523 | A | * | 1/1998 | Sternberg |

FOREIGN PATENT DOCUMENTS

| | | |
|---|---|---|
| DE | 95639 | 5/1897 |
| FR | 2227801 | 11/1974 |
| GB | 1313471 | 4/1973 |

* cited by examiner

*Primary Examiner*—Benjamin H. Layno
*Assistant Examiner*—V K Mendiratta
(74) *Attorney, Agent, or Firm*—Woodard, Emhardt, Naughton Moriarty & McNett

(57) ABSTRACT

A compact game playing apparatus that is easy to carry and use when traveling. The apparatus contains an elongate sheet coupled to two spindles. A plurality of game playing surfaces are printed on the elongate sheet, and rotation of the spindles operate to align a selected one of these game playing surfaces with a window in the apparatus housing. A magnet attracting metal surface is positioned below the exposed game playing surface so that game pieces, which include magnets, may be placed on the game playing surface without being inadvertently displaced. The housing further contains an integral die throwing apparatus, and an integral drawer for holding game pieces when not in use.

4 Claims, 4 Drawing Sheets

GAME PLAYING APPARATUS

This appln is a Div of Ser. No. 08/716,050 Sep. 19, 1996 U.S. Pat. No. 5,918,880, which is a division of application Ser. No. 08/386,291, filed Feb. 9, 1995, now U.S. Pat. No. 5,588,654.

TECHNICAL FIELD OF THE INVENTION

The present invention relates generally to a game playing apparatus, and more particularly to a game playing apparatus having magnetic game pieces and an integral die throwing apparatus.

BACKGROUND OF THE INVENTION

Board games have been in existence for thousands of years and are believed to date back to the very dawn of civilization. Some games, like chess or checkers, have become enduring favorites, while others come and go with the ebb and flow of fashion. Not even the dazzling fast paced action of video games seems to have lessened the popularity of board games.

Even with their popularity, however, board games have several serious disadvantages which have never been adequately addressed. For example, board games are notoriously bulky. The standard configuration comprises a cardboard playing surface (usually folded) and game pieces stored in a cardboard box. This relatively large size contributes to increased cost of the board games, requires a fairly large space in which to store several board games, and makes it difficult to travel with board games.

Another problem with board games is that they normally contain several playing pieces, including a die or dice, that are easily lost, especially when used by younger children. Most board games become unusable when even one of the playing pieces is lost, all of the pieces being required during play of the game. This problem is compounded by the fact that most games require the throwing of a die or dice during game play. Children often find it difficult to throw the dice and keep them on the board. Also, the dice frequently collide with other game pieces placed on the board, knocking them off of the board. Such falling off of the board contributes to loss of the dies and the game pieces.

It is also difficult to travel with board games. As previously mentioned, they are quite bulky. Additionally, children often wish to play board games in an automobile while traveling in order to relieve the monotony. This presents several problems. As there is little space for laying the cardboard playing surface, the often non-level playing surface causes the game pieces to slide from position or completely off of the board (which can end the game in a game like chess, where the exact position of every piece is critical). Also, the motion of the automobile can cause displacement of the game pieces. Finally, it is difficult for children wearing seatbelts to retrieve the errant game pieces or dice that roll from the board. In fact, an attempt to retrieve them often results in completely overturning the playing surface.

There is therefore a need in the prior art for a board game that is compact, inexpensive, easy to travel with and use during travel, which provides protection against losing game pieces or dies. The present invention is directed toward meeting these needs.

SUMMARY OF THE INVENTION

The present invention relates to a compact game playing apparatus that is easy to carry and use when traveling. The apparatus contains an elongate sheet coupled to two spindles. A plurality of game playing surfaces are printed on the elongate sheet, and rotation of the spindles operate to align a selected one of these game playing surfaces with a window in the apparatus housing. A magnet attracting metal surface is positioned below the exposed game playing surface so that game pieces, which include magnets, may be placed on the game playing surface without being inadvertently displaced. The housing further contains an integral die throwing apparatus, and an integral drawer for holding game pieces when not in use.

In one form of the invention, a game playing apparatus is disclosed, comprising a housing having an opening therein; first and second spindles rotatably engaged with the housing and positioned on opposite sides of the opening; an elongate sheet having first and second ends, the first end being attached to the first spindle and the second end being attached to the second spindle, wherein the elongate sheet has a plurality of game playing surfaces marked thereon, such that rotation of one of the first and second spindles is operative to align a selected one of the game playing surfaces with the opening; and a die-throwing device coupled to the housing and including a die, the die-throwing device including an actuator operable to cause the die to randomly display a die face in response to activation of the actuator.

In another form of the invention a game playing apparatus is disclosed, comprising: a housing operable to display a plurality of game playing surfaces; and a die throwing device coupled to the housing, and including a die, the die-throwing device including an actuator operable to cause the die to randomly display a die face in response to activation of the actuator.

In another form of the invention a die throwing apparatus is disclosed, comprising: a die; an actuator; a die spindle, the die being rotatably mounted on the die spindle; a die spinning member operable to spin the die on the die spindle when the die spinning member is moved in a first direction; and a die stopping member coupled to the actuator and operable to move in the first direction when the actuator is activated, the die stopping member further operable to cause the die spinning member to move in the first direction when the die stopping member moves in the first direction, thereby spinning the die; wherein the die stopping member is further operable to move in a second direction opposite the first direction when the actuator is deactivated, wherein movement of the die stopping member in the second direction causes the die to stop spinning.

DESCRIPTION OF THE PREFERRED EMBODIMENT

Figure 1:
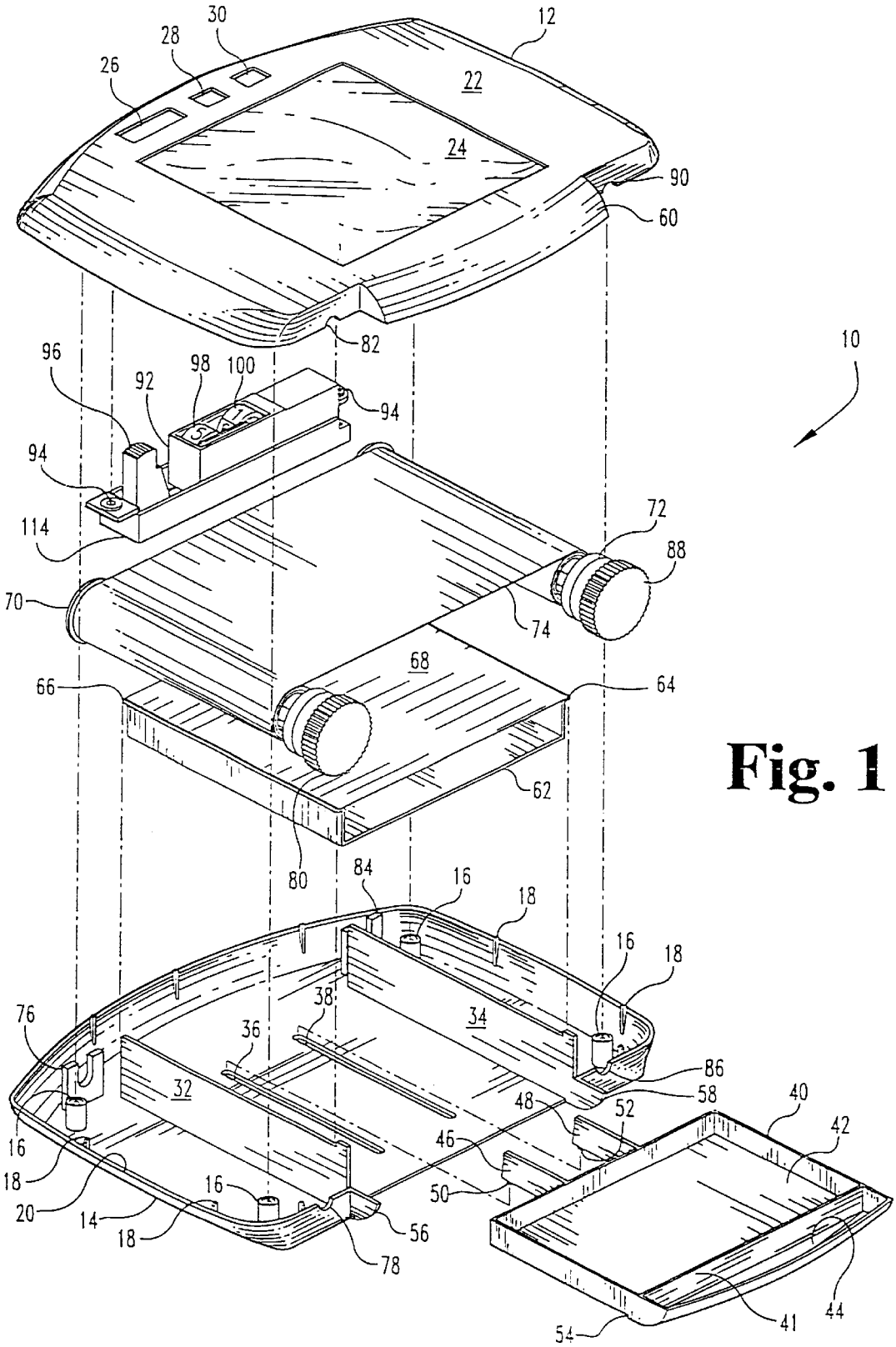
FIG. 1 is an exploded perspective view of a preferred embodiment of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to a game playing apparatus which is compact, enables several different board games to be played upon its playing surface, positively maintains the game pieces on the playing surface, includes an integral compartment for storage of the game pieces, and also includes an integral die throwing apparatus. Referring to FIG. 1, a first embodiment of the present invention is illustrated in an exploded perspective view, and indicated generally at 10. The game playing apparatus 10 is enclosed in a housing which comprises an upper housing member 12 and a lower housing member 14. The housing members 12 and 14 are coupled to one another by means of screws (not shown) which pass through the bottom surface of the lower housing member 14, through support bosses 16, and threadingly engage equivalent support bosses (not shown) on the bottom surface of the upper housing member 12. The lower housing member 14 further includes integral posts 18 spaced around the perimeter thereof and extending above the perimeter surface 20. The posts 18 function to provide lateral support to prevent the upper and lower housing members from being substantially laterally displaced before the screws are engaged through the support bosses 16.

The upper housing member 12 includes a substantially flat upper surface 22 having a window 24 formed therein. The window 24 is preferably covered with a clear protective surface, such as a piece of clear plastic. The upper housing member 12 further comprises holes 26, 28 and 30 formed therein. The holes 26–30 provide access to the die throwing apparatus, as described hereinbelow.

The bottom support member 14 further includes two vertical partition members 32 and 34 which are integrally formed with the bottom housing member 14. Two longitudinal slots 36 and 38 are formed in the bottom surface of the bottom support member 14 and extend substantially parallel to the partitions 32 and 34. Thus positioned, the space between the partitions 32 and 34 is adapted to receive drawer 40 which is operable to slide into and out of the space between the partitions 32 and 34. The drawer 40 is formed with a lateral partition 41 which divides the interior of the drawer into compartments 42 and 44. The drawer 40 further includes beams 46 and 48 which extend from the rear surface of the drawer 40. The beam 46 includes the post 50 which rides in the longitudinal track 36, while the beam 48 includes a post 52 which rides within the longitudinal track 38. In this way, the engagement of the post 50 with the track 36 and the engagement of the post 52 with the track 38 maintain alignment of the drawer 40 within the space between partitions 32 and 34, and also prevent the drawer 40 from being pulled completely out of the space. The bottom front edge of the drawer 40 includes a lip 54 which is operative to prevent excessive insertion of the drawer 40 into the space between the partitions 32 and 34. The lip 54 further serves as a gripping surface in order to grip the drawer 40 while extending it from the game playing apparatus 10.

The bottom housing member 14 further includes projecting fins 56 and 58 which are positioned substantially flush with the front side surfaces of the drawer 40 when it is in the retracted position. Furthermore, the upper housing member 12 includes a projecting portion 60 which is positioned substantially flush with the upper front surface of the drawer 40 in its retracted position. The fins 56 and 58 and the projecting portion 60 provide protection for the drawer 40 when it is in its retracted position, so that excessive forces may not be applied to the drawer 40. The upper housing member 12, the lower housing member 14, and the drawer 40 are all preferably formed from injection molded plastic.

A playing surface support member 62 is also provided, which includes a projecting flange 64 which rests on the top surface of partition 34, as well as a projecting flange 66 which rests on the top surface of partition 32. The bottom surface of support member 62 is substantially flush with the top surface of the drawer 40 when the drawer 40 is in its retracted position. The top surface 68 of the support member 62 is formed from a metal, such as iron or steel, which is attracted by a magnetic field. The function of support surface 68 is described in greater detail hereinbelow.

The game playing apparatus 10 further includes two spool-shaped spindles 70 and 72 to which are attached an elongate sheet 74. The spindle 70 rotatably rests upon support 76 and the semi-circular recess 78 formed in the front side wall of the bottom housing member 14. When so positioned, the spindle 70 may be rotated about its longitudinal axis by means of a knob 80 which extends exterior to the housing members 12 and 14. The top housing member 12 includes a semi-circular opening 82 which mates with the opening 78 in the bottom housing member 14 in order to completely enclose the portion of the spindle 70 which projects from the housing 12, 14. Similarly, the spindle 72 is supported by a support 84 formed integrally with the bottom housing member 14, and a semi-circular recess 86 formed in the front side wall of the bottom housing member 14. A knob 88 is attached to the spindle 72 for rotation thereof. The upper housing member 12 includes a semi-circular recess 90 which cooperates with the recess 86 in the bottom housing member 14 in order to completely enclose the portion of the spindle 72 which projects from the housing 12, 14.

The bottom surface of the elongate sheet 74 is supported by the support surface 68. The top surface of the elongate sheet 74 is printed with several game playing surfaces which may be exposed through the window 24 by rotation of either of the knobs 80 or 88. Because the elongate sheet 74 is preprinted with separate game playing surfaces, such as chess, checkers, parchessi, chinese checkers, or any other desired game playing surface, the game playing apparatus 10 may function as the playing surface for a relatively large quantity of different games.

The game playing apparatus 10 further includes an integral die throwing apparatus 92 which is attached to the upper housing member 12 by means of screws (not shown) which extend through the mounting holes 94 and threadingly engage support bosses (not shown) integrally formed with the bottom surface of the upper housing member 12. In this position, an actuating lever 96 of the die throwing apparatus 92 extends through the opening 26 in the upper housing member 12. Additionally, the faces of die members 98 and 100 are visible through the openings 28 and 30, respectively. The die throwing apparatus 92 is operated by laterally displacing the lever 96, which causes the dies 98 and 100 to spin rapidly. Upon release of the lever 96, it returns to its initial position, thereby stopping the dies 98 and 100 with a random die face showing through each of the windows 28 and 30. Because the die throwing apparatus 92 is formed integrally with the game playing apparatus 10, it is not necessary to have a separate pair of dice, which could possibly roll off of the game playing surface or become lost.

Figure 2:
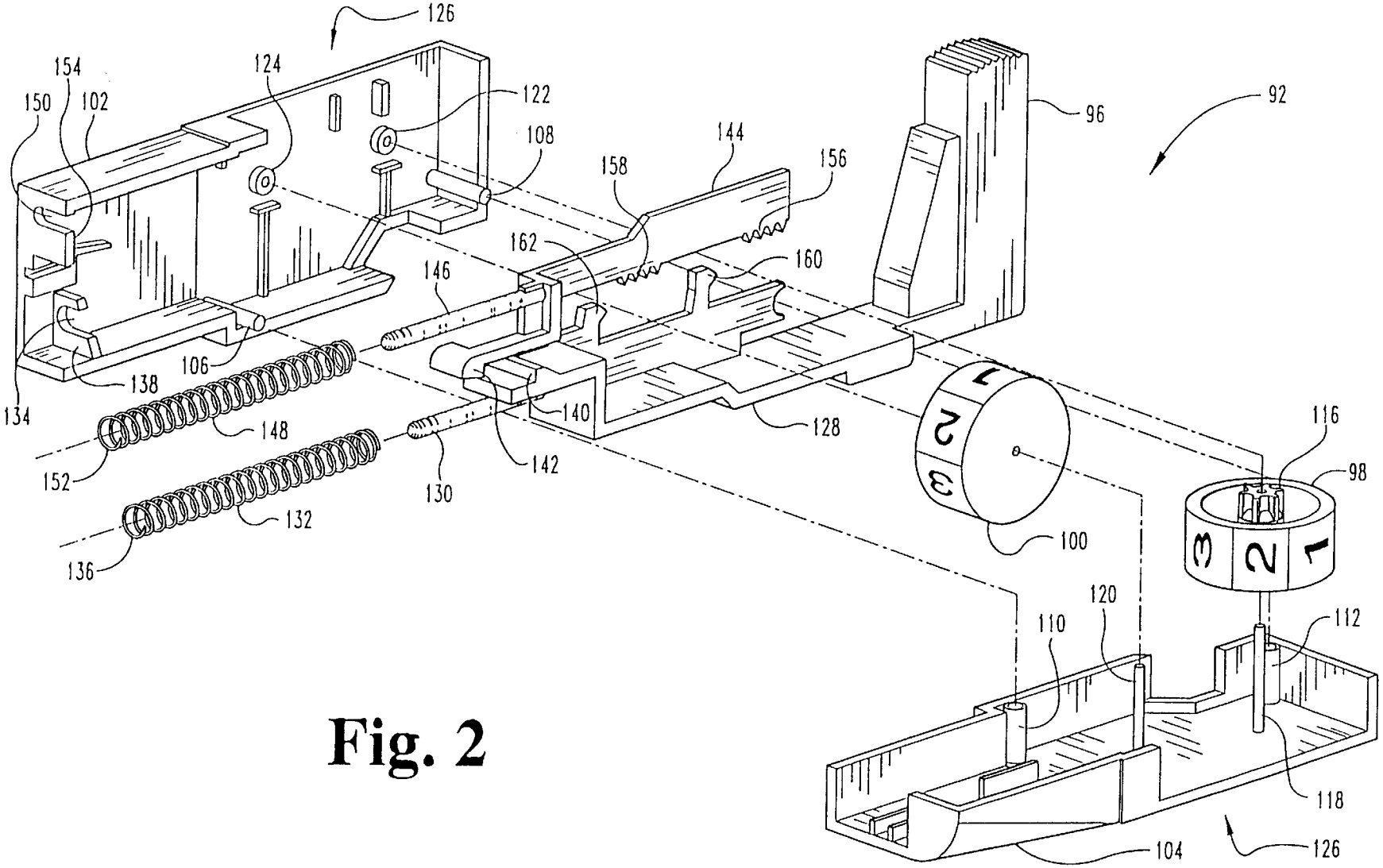
FIG. 2 is an exploded perspective view of a preferred embodiment die throwing apparatus of the present invention.

Referring now to FIG. 2, the construction and operation of the die throwing apparatus 92 will be described in greater detail. The die throwing apparatus 92 is formed within two housing halves 102 and 104 which are coupled to one another by means of pegs 106 and 108 which engage bosses 110 and 112, respectively, in a sliding frictional fit. Once assembled, the housing members 102 and 104 rest within a tray 114 (see FIG. 1). The dies 98 and 100 are formed as cylindrical drums, having die faces marked 1–6, for example, formed on the exterior surface thereof. Each of the dies 98 and 100 includes a toothed gear 116 axially mounted on a side surface thereof. Spindles 118 and 120 are mounted to the housing member 104 and extend axially through the dies 98 and 100, respectively, and into spindle brackets 122 and 124, respectively. Thus positioned, the dies 98 and 100 are free to spin on the spindles 118 and 120 and the top portion of the dies are visible through the window 126 formed in the housing halves 102 and 104.

The lever 96 is attached to a stopping member 128 which includes a post 130 of an end thereof opposite the lever 96. The post 130 is adapted to receive a spring 132 thereon. When assembled, the post 130 extends through the opening 134 when the lever 96 is displaced toward the dies 98 and 100, however the end 136 of the spring 132 abuts against the member 138 integrally formed with the housing 102, thereby compressing the spring 132. A lip 140 on the stopping member 128 contacts a lip 142 on a spinning member 144 when the lever 96 is displaced toward the dies 98 and 100. The spinning member 144 includes a post 146 on which is carried a spring 148. When the spinning member 144 is displaced by the stopping member 128, the post 146 extends through the opening 150. However, the end 152 of the spring 148 abuts against the member 154 which is formed in the end of the housing 102, thereby compressing the spring 148. The compression of the springs 132 and 148 tend to urge the stopping member 128 and the spinning member 144 back to their original positions when the force applied to the lever 96 is removed.

In operation, when the lever 96 is displaced toward the dies 98 and 100, the teeth 156 and 158 formed on the spinning member 144 engage the toothed gear 116 of the dies 98 and 100, respectively. As the spinning member 144 is displaced, the moving teeth 156 and 158 impart a rotational velocity to the dies 98 and 100. If the lever 96 is advanced through its entire range of motion, the teeth 156 and 158 travel clear of the toothed gears 116, thereby allowing the dies 98 and 100 to spin freely on the spindles 120. When the user releases the lever 96, the compressed springs 132 and 148 return both the spinning member 144 and the stopping member 128 to their original positions. The stopping member 128 includes hooks 160 and 162 integrally formed therewith. When the stopping member 128 is returned to its initial position, the hooks 160 and 162 engage the toothed gears 116 of the dies 98 and 100, respectively. Such engagement of the hooks 160 and 162 with the toothed gears 116 cause the dies 98 and 100 to abruptly stop spinning. The teeth on the gears 116 are spaced such that one of the faces of the dies 98 and 100 will be positioned vertically when the gears 116 are engaged by the hooks 160 and 162, such that these die faces are directly visible through the opening 126, and therefore through the openings 28 and 30 of the upper housing member 12.

It will be appreciated by those skilled in the art that with a relatively simple construction, the die throwing apparatus 92 is operable to both spin and stop the dies 98 and 100 by operation on a single toothed gear 116. With the exception of the springs 132 and 148 and the spindles 118 and 120, all of which are preferably formed of metal, all of the pieces of the die throwing apparatus 92 are preferably formed from injection molded plastic. The mechanisms for spinning and stopping the dies 98 and 100 act upon the same toothed gear on each of the dies, thereby simplifying the operation of the apparatus and the design of the dies, which require only the toothed gear 116 in order to effect both spinning and stopping.

Figure 3A:
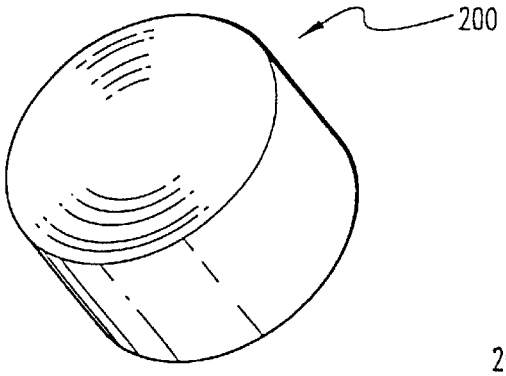
FIGS. 3A–B are perspective views of a first embodiment game piece of the present invention.
Figure 3B:
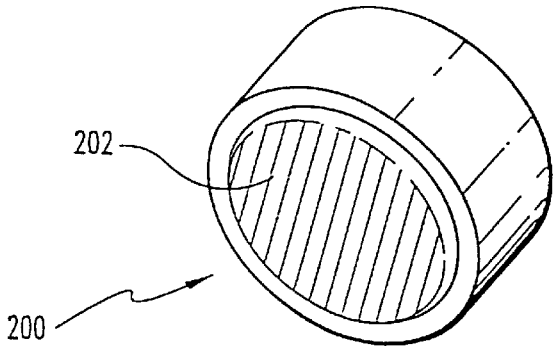

Referring now to FIGS. 3A and 3B, there is illustrated a first embodiment game piece of the present invention, indicated generally at 200. The game piece 200 preferably has a cylindrical shape and is formed of plastic. The underside of the game piece 200 has a hollow recess in which is carried a magnet 202. During use of the game playing apparatus 10, a desired game playing surface is advanced into registration with the window 24 by means of rotating the knobs 80 and 88, and appropriate game pieces 200 are positioned on the window 24 at locations required for play of the game. Magnetic attraction between the magnet 202 of each game piece 200 and the magnetic attracting surface 68 of the game playing surface support member 62 prevents the game pieces 200 from inadvertently moving on the surface of the game playing apparatus 10. This substantially decreases the likelihood that the game pieces 200 will become lost. The game pieces 200 are preferably provided in a plurality of colors, in order to facilitate play of the various games included on the elongate sheet 74. It will be appreciated by those skilled in the art that the game pieces 200 may take any desired form, so long as there is magnetic attraction between the game piece 200 and the surface 68. This includes the alternative embodiment of providing a magnetized surface 68 and including a piece of magnet attracting metal within each game piece 200.

Figure 3C:
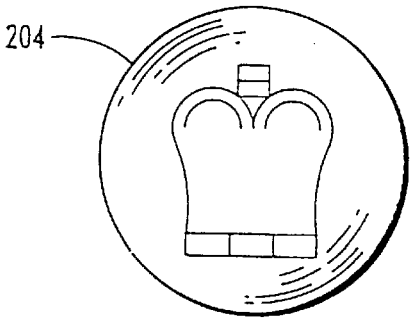
FIG. 3C is a plan view of a second embodiment game piece of the present invention.

If one of the game playing surfaces on the elongate sheet 74 is designed for playing the game of checkers, it is desirable that the set of game pieces 200 include enough red and black game pieces 200 in order to play a standard game of checkers. Furthermore, it is desirable that these red and black game pieces 200 be embossed or marked thereon with a crown design, as is common in the game of checkers, and as shown in FIG. 3C.

Figure 4:
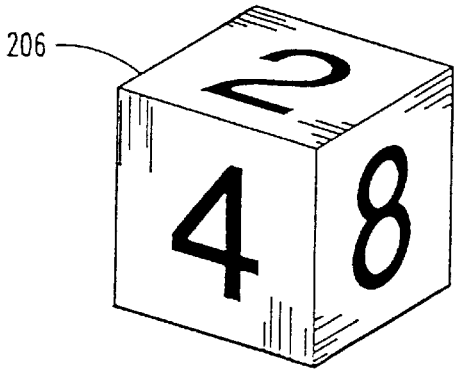
FIG. 4 is a perspective view of a doubling die of the present invention.

Referring to FIG. 4, if the elongate sheet 74 includes a game playing surface for the game of backgammon, it is preferable that the game playing apparatus 10 be supplied with a doubling cube 206 as illustrated in FIG. 4. The doubling cube 206 may be conveniently stored within the tray 40. The doubling cube 206 may also include a magnet (not shown) so that it may not be inadvertently dislodged from the window 24 over the game playing surface during play.

Figure 5:
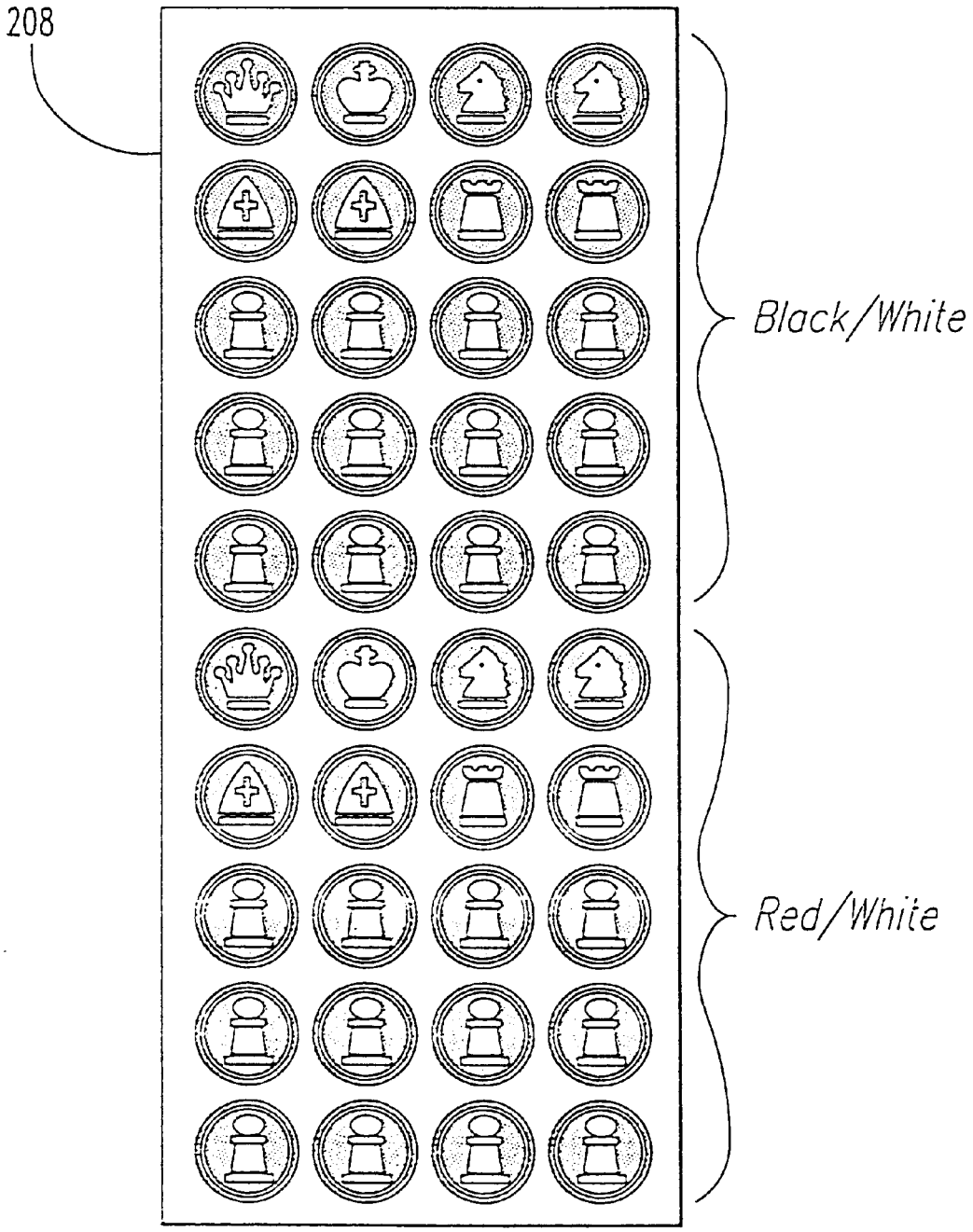
FIG. 5 is a plan view of a game piece labeling sheet of the present invention.

If one of the game playing surfaces printed on the elongate sheet 74 is for the game of chess, it is further preferred that the game playing apparatus 10 include a sheet of adhesive labels 208 substantially as illustrated in FIG. 5. Each of the labels on the sheet 208 correspond to a game piece for use in playing the game of chess. These labels may be removed from the sheet 208 and attached to the top surface of several of the game pieces 200, so that those game pieces 200 may be used in playing a game of chess. In the preferred embodiment, one half of the labels on the sheet 208 are printed in a different color than the other half of the labels on the sheet 208, in order to distinguish game pieces for different players. In the preferred embodiment, one half of the labels on the sheet 208 are printed black and white, while the other half of the labels are printed red and white. Those skilled in the art will recognize that the labels on the sheet 108 may be designed in any convenient form and may be reproduced in any desired color. Furthermore, there may be other game playing surfaces chosen for the elongate sheet 74 which will require other specially marked game pieces 200. It is contemplated that the game playing apparatus 10 may be supplied with any number of such sheets of labels which may be designed specifically for the chosen game. It is further contemplated that the game playing apparatus 10 may be provided with unique game pieces representing the standard chess pieces, in which case the label sheet 208 would not be required to play chess.

It will be appreciated by those skilled in the art that the game playing apparatus 10 of the present invention represents a substantial improvement in the board games of the prior art. Because of its compact size, and its inclusion of a plurality of game playing surfaces on the elongate sheet 74, the game playing apparatus 10 may be conveniently carried while traveling and will provide game playing surfaces for a plurality of games within a very small space. Furthermore, the inclusion of the integral die throwing apparatus 92 ensures that the dice will always be available for use with the game playing apparatus, and that there is no chance of throwing the dice and having them land off of the game playing surface and possibly being lost. A further advantage is provided by the present invention in that each of the game pieces 200 include magnets which hold them to the surface of the window 24 with enough force to prevent their inadvertent displacement either on the window 24 or completely off of the game playing apparatus 10. Furthermore, the game playing apparatus 10 includes the integral drawer 40 which is well adapted for storage of the game pieces 200 when not in use. This provides further assurance that the game pieces 200 will not be lost when the game playing apparatus 10 is not in use. Additionally, the game playing apparatus 10 exhibits the considerable advantage of being formed from plastic which is considerably more resilient and wear resistant than are the standard cardboard boxes and playing surfaces of the board games known in the prior art. It is therefore expected that the useful life of the game playing apparatus 10 will be substantially longer than the useful lives of the prior art board games. Finally, the game playing apparatus 10 of the present invention is substantially less expensive to manufacture than would be separate board games for each of the games that may be included on the elongate sheet 74. For example, a preferred embodiment of the present invention includes ten separate game playing surfaces on the elongate sheet 74. The cost of ten separate cardboard board games to implement these ten separate games would be many times greater than the expensive of producing the game playing apparatus 10 of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A game playing apparatus, comprising:

a housing operable to display a plurality of game playing surfaces; and a die throwing device coupled to the housing and including a die, the die-throwing device including an actuator operable to cause the die to randomly display a die face in response to activation of the actuator.

2. The game playing apparatus of claim 1, further comprising a drawer slidingly engaged with the housing, said drawer adapted to hold a plurality of game pieces.

3. The game playing apparatus of claim 1, wherein the die-throwing device comprises:

a die spindle, the die being rotatably mounted on the die spindle;

a die spinning member operable to spin the die on the die spindle when the die spinning member is moved in a first direction; and a die stopping member coupled to the actuator and operable to move in the first direction when the actuator is activated, the die stopping member further operable to cause the die spinning member to move in the first direction when the die stopping member moves in the first direction, thereby spinning the die;

wherein the die stopping member is further operable to move in a second direction opposite the first direction when the actuator is deactivated, wherein movement of the die stopping member in the second direction causes the die to stop spinning.

4. The game playing apparatus of claim 3, further comprising:

a toothed gear coupled to the die and axially aligned therewith;

wherein the die is spun by interaction of the die spinning member with the toothed gear, and the die is stopped by interaction of the die stopping member with the toothed gear.

* * * * *